US011085733B2

(12) United States Patent
Zhang

(10) Patent No.: US 11,085,733 B2
(45) Date of Patent: Aug. 10, 2021

(54) QUICK DISASSEMBLY AND ASSEMBLY DEVICE FOR HOLSTER AND WAIST GUARD

(71) Applicant: Cytac Technology Limited, Shenzhen (CN)

(72) Inventor: Yong Zhang, Shenzhen (CN)

( * ) Notice: Subject to any disclaimer, the term of this patent is extended or adjusted under 35 U.S.C. 154(b) by 105 days.

(21) Appl. No.: 16/429,096

(22) Filed: Jun. 3, 2019

(65) Prior Publication Data

US 2020/0309484 A1 Oct. 1, 2020

(30) Foreign Application Priority Data

Mar. 26, 2019 (CN) ..... 201920397199.4

(51) Int. Cl.
*F41C 33/04* (2006.01)

(52) U.S. Cl.
CPC ..... *F41C 33/041* (2013.01)

(58) Field of Classification Search
CPC .... F41C 33/041; F41C 33/045; F41C 33/043; F41C 33/04; Y10T 403/7005; Y10T 403/595; A45F 2200/0591; A45F 5/021; A45F 2005/025; A45F 2005/027; A45F 2005/028; A45F 2005/026; A45F 5/02; F16M 11/2014; F16M 11/2021; F16M 11/2007
USPC ..... 224/243, 197–198, 269–272, 255–256, 224/240, 663–670, 648–649; 24/195, 24/590.1
See application file for complete search history.

(56) References Cited

U.S. PATENT DOCUMENTS 9,423,210 B2 * 8/2016 Pellegrini ..... F41C 33/045

FOREIGN PATENT DOCUMENTS

DE 102006061451 B4 * 2/2011 ..... A45F 5/021

OTHER PUBLICATIONS

Dueck Peter, DE 102006061451 B4 Translation, Feb. 2011 (Year: 2011).*

* cited by examiner

*Primary Examiner* — Nathan J Newhouse
*Assistant Examiner* — Matthew T Theis
(74) *Attorney, Agent, or Firm* — HYIP

(57) ABSTRACT

The disclosure discloses a quick disassembly and assembly device for a holster and a waist guard, including a detachable quick-disassembly main body and a sliding slot, wherein the quick-disassembly main body is sleeved inside the sliding slot; a first pressing button is mounted on one side of the quick-disassembly main body, and a first clamping slot, which is matched with the first pressing button, is provided on the side of the sliding slot; a second pressing button is disposed on the bottom of the quick-disassembly main body, and a second clamping slot, which is matched with the second pressing button, is provided on the bottom of the sliding slot; and the angle of the rotating gear of the main body can be adjusted by pressing the second pressing button.

10 Claims, 5 Drawing Sheets

QUICK DISASSEMBLY AND ASSEMBLY DEVICE FOR HOLSTER AND WAIST GUARD

TECHNICAL FILED

The disclosure relates to a connecting device, in particular to a quick disassembly and assembly device for a holster and a waist guard.

BACKGROUND

The holster is a basic item for law enforcement officers to protect firearms. The waist guard is a component that cooperates with the holster, and the two work together to achieve the wearing of the firearm.

There are some problems in the installation of the existing holster and the waist guard. For example, Assembly of the holster and the waist guard takes a long time, and the holster is not easily removed after assembly. These problems can affect the normal use of firearms.

SUMMARY OF THE DISCLOSURE

In order to overcome the above technical problems, the disclosure provides a quick disassembly and assembly device for a holster and a waist guard, which has the effects of quick disassembly and assembly of the holster and the waist guard.

The present disclosure adopts the solution as below:

A quick disassembly and assembly device for a holster and a waist guard, including a detachable quick-disassembly main body and a sliding slot, wherein the quick-disassembly main body is sleeved inside the sliding slot; a first pressing button is mounted on one side of the quick-disassembly main body, and a first clamping slot, which is matched with the first pressing button, is provided on one side of the sliding slot;

a second pressing button is disposed on a bottom of the quick-disassembly main body, and a second clamping slot, which is matched with the second pressing button, is provided on a bottom of the sliding slot; a rotating gear of main body are provided on a center of the quick-disassembly main body, the rotating gear of main body is connected to the second pressing button by a toggle hook, and an angle of the rotating gear of the main body is adjusted by pressing the second pressing button.

Further, the first pressing button and the toggle hook are respectively connected to the rotating gear of the main body by a spring.

Further, a plurality of toggle grooves are provided on the rotating gear of the main body at intervals in the circumferential direction; the toggle grooves match with the toggle hook.

Further, the quick-disassembly main body is slidably connected to the sliding slot.

Further, an outer wall of the quick-disassembly main body is in contact with an inner wall of the sliding slot.

Further, the quick-disassembly main body, the sliding slot and the rotating gear of the main body are provided with a center hole.

Or, the quick-disassembly main body and the sliding slot are provided with a plurality of mounting holes, respectively.

Further, three first mounting holes are provided in the quick-disassembly main body, and the three first mounting holes are in triangular distribution.

Further, three second mounting holes are provided in the sliding slot, and the three second mounting holes are in triangular distribution.

Further, the first pressing button passes through the first clamping slot, the second pressing button passes through the second clamping slot.

The advantageous effects of the disclosure are as below:

(1) The quick-disassembly main body of the disclosure cooperates with the sliding slot, and the quick-disassembly main body slides into the sliding slot, so that the quick assembly of the holster and the waist guard can be realized;

(2) The quick-disassembly main body of the disclosure is provided with a first pressing button, and the quick release function of the holster and the waist guard can be realized by pressing the first pressing button, which is convenient to operate and saves time.

(3) The bottom of the quick-disassembly main body of the disclosure is provided with a second pressing button, and the angle of the holster can be adjusted by pressing the second pressing button, so that the user can adjust the appropriate angle to perform any action.

In the figure: 1. quick-disassembly main body, 2. sliding slot; 3. first pressing button; 4. second pressing button; 5. second mounting hole; 6. bolt; 7. first mounting hole; 8. first clamping slot; 9. second clamping slot; 10. rotating gear of main body; 11. center hole; 12. toggle hook; 13. spring.

DETAILED DESCRIPTION OF THE EMBODIMENTS

Embodiment 1

As shown in FIG. 1 to FIG. 4, the present embodiment provides a quick disassembly and assembly device for a holster and a waist guard, including a quick-disassembly main body 1 and a sliding slot 2. The quick-disassembly main body 1 is configured to connect with the holster, the sliding slot 2 is configured to connect with the waist guard, and the quick-disassembly main body 1 and the sliding slot 2 are in detachable connection.

Figure 1:
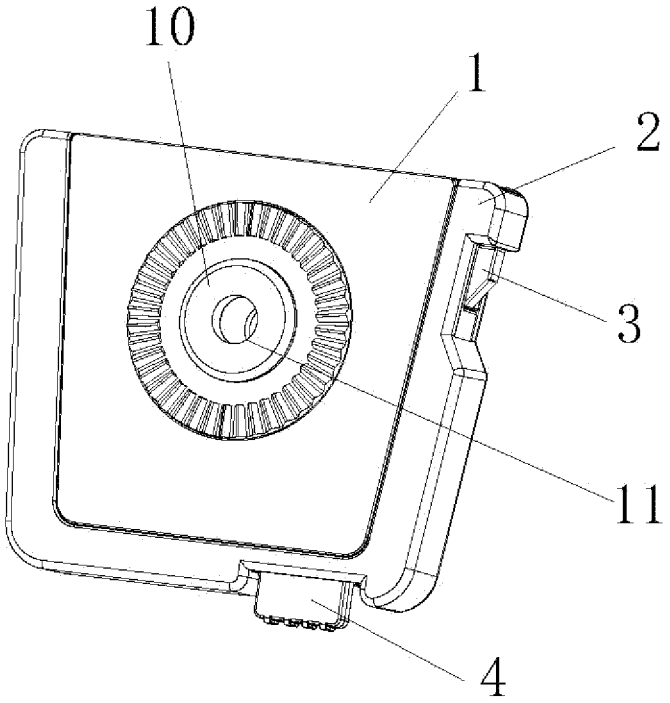
FIG. 1 is a perspective view of Embodiment 1 of the present disclosure.
Figure 2:
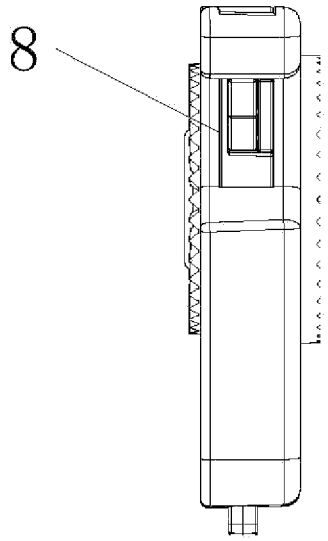
FIG. 2 is a lateral view of Embodiment 1 of the present disclosure.
Figure 3:
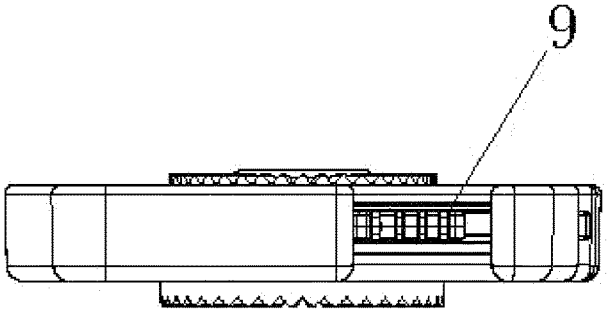
FIG. 3 is a bottom view of Embodiment 1 of the present disclosure.
Figure 4:
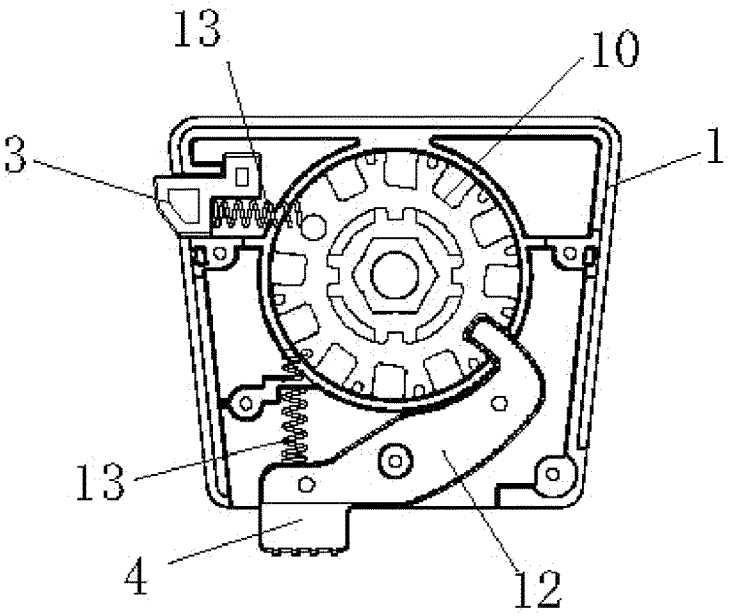
FIG. 4 is a schematic view showing the internal structure of a quick-disassembly main body according to Embodiment 1 of the present disclosure.
Figure 5:
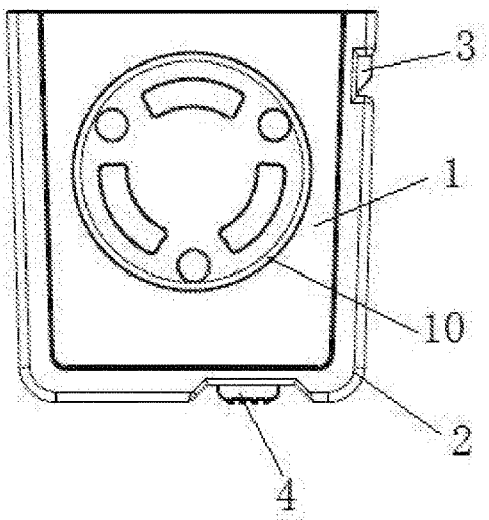
FIG. 5 is a front elevational view of Embodiment 2 of the present disclosure.
Figure 6:
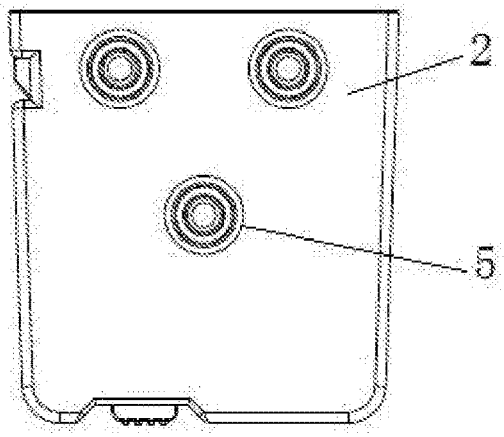
FIG. 6 is a rear elevational view of Embodiment 2 of the present disclosure.
Figure 7:
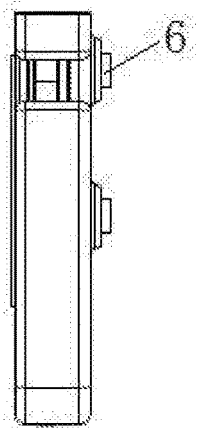
FIG. 7 is a lateral view of Embodiment 2 of the present disclosure.
Figure 8:
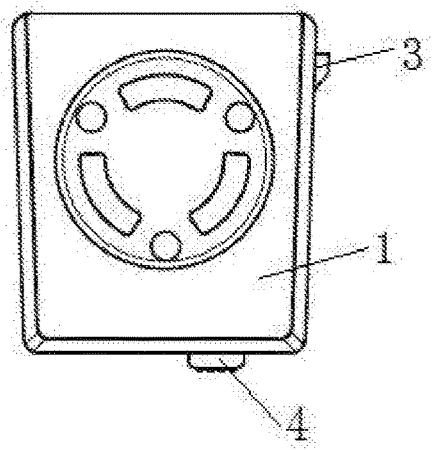
FIG. 8 is a front elevational view of the quick-disassembly main body according to Embodiment 2 of the present disclosure.
Figure 9:
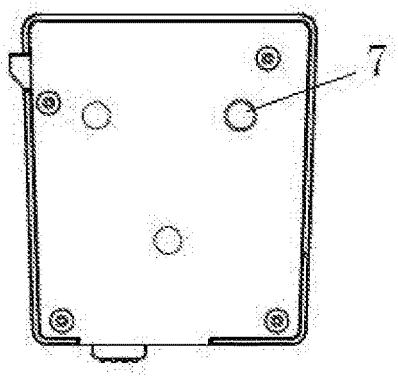
FIG. 9 is a rear view of the quick-disassembly main body according to Embodiment 2 of the present disclosure.
Figure 10:
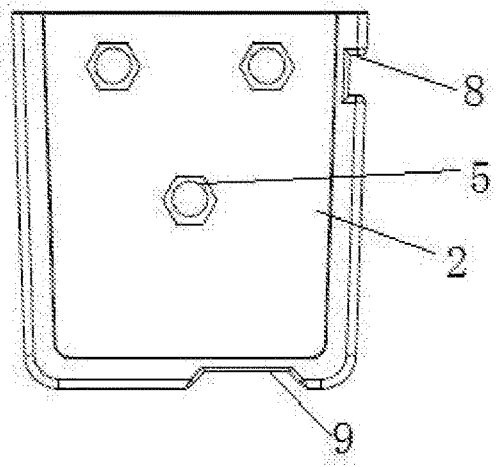
FIG. 10 is a front view of a sliding slot according to Embodiment 2 of the present disclosure.
Figure 11:
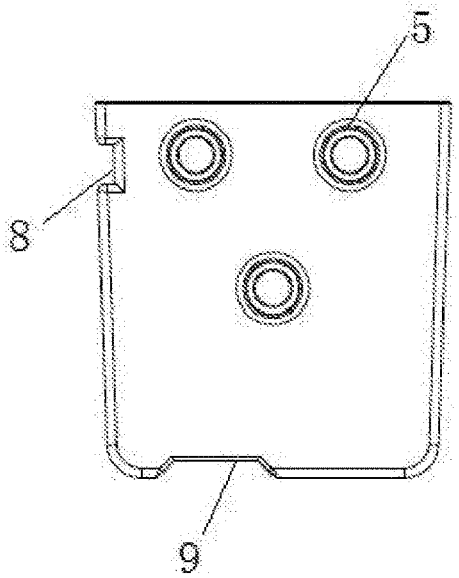
FIG. 11 is a rear view of the sliding slot according to Embodiment 2 of the present disclosure.

A rotating gear of main body 10 is mounted in the central position of the quick-disassembly main body 1. A plurality of toggle grooves are provided in the rotating gear of main body 10 at intervals in the circumferential direction, as shown in FIG. 4.

In this embodiment, the longitudinal section of the quick-disassembly main body 1 is of an isosceles trapezoidal structure, and the first pressing button 3 is mounted on the upper position at one side of the quick-disassembly main body, and the first pressing button 3 and the rotating gear of main body 10 are connected by a spring 13. The first pressing button 3 can be pressed into the interior of the quick-disassembly main body 1 and can automatically rebound. By pressing the first pressing button 3, the quick separation of the quick-disassembly main body 1 and the sliding slot 2 is realized.

A second pressing button 4 is disposed at the bottom of the quick-disassembly main body 1, and the second pressing button 4 is offset from the center position of bottom of the quick-disassembly main body 1.

The second pressing button 4 is a member protruding from the surface of the quick-disassembly main body 1, of which the shape can be arbitrarily set; the surface of the second pressing button 4 is provided with convex points for easy operation.

The second pressing button 4 is connected to the toggle hook 12, the toggle hook 12 is rotatably connected to the quick-disassembly body 1, and the spring 13 is connected between the toggle hook 12 and the rotating gear of main body 10. When the second pressing button 4 is pressed, the second pressing button 4 drives the toggle hook 12 to move, so as to make the toggle hook 12 cooperate with different toggle grooves, thereby adjusting the angle of the holster, so that the user can adjust the appropriate angle to perform any action.

The quick-disassembly main body 1, the sliding slot 2 and the rotating gear of main body 10 are provided with a central hole 11 for connecting the holster and the waist guard.

The sliding slot 2 is sleeved on the outer side of the quick-disassembly main body 1, and one side of the sliding slot opens and the other sides are closed, and the whole shape of the sliding slot is U-shaped, which is wrapped on the outer side of the quick-disassembly main body 1.

The outer wall of the quick-disassembly main body 1 is in contact with the inner wall of the sliding slot 2.

One side of the sliding slot 2 is provided with the first clamping slot 8 that cooperates with the first pressing button 3, and the second clamping slot 9 that cooperates with the second pressing button 4 is disposed at the bottom thereof.

The first clamping slot 8 and the second clamping slot 9 are respectively provided with slotted holes for the first pressing button 3 and the second pressing button 4 to pass through.

The usage method of this embodiment is:

The part of the rotating gear of main body 10 of the quick-disassembly main body 1 is connected with the holster through a screwy; and the sliding slot 2 is fixed with the waist guard by the screw, and the quick-disassembly main body 1 slides down into the sliding slot. At this time, the first pressing button 3 is disposed in the first clamping slot 8, the second pressing button 4 is disposed in the second clamping slot 9 to realize quick connection between the holster and the waist guard.

When the holster and the waist guard are to be separated, the first pressing button 3 is pressed, and the holster connected to the quick-disassembly main body 1 is pulled out to realize the quick release function.

Embodiment 2

As shown in FIG. 5 to FIG. 12, the present embodiment provides a quick disassembly and assembly device for a holster and a waist guard, including a quick-disassembly main body 1 and a sliding slot 2. The quick-disassembly main body 1 is configured to connect with the holster, the sliding slot 2 is configured to connect with the waist guard, and the quick-disassembly main body 1 and the sliding slot 2 are in detachable connection.

Figure 12:
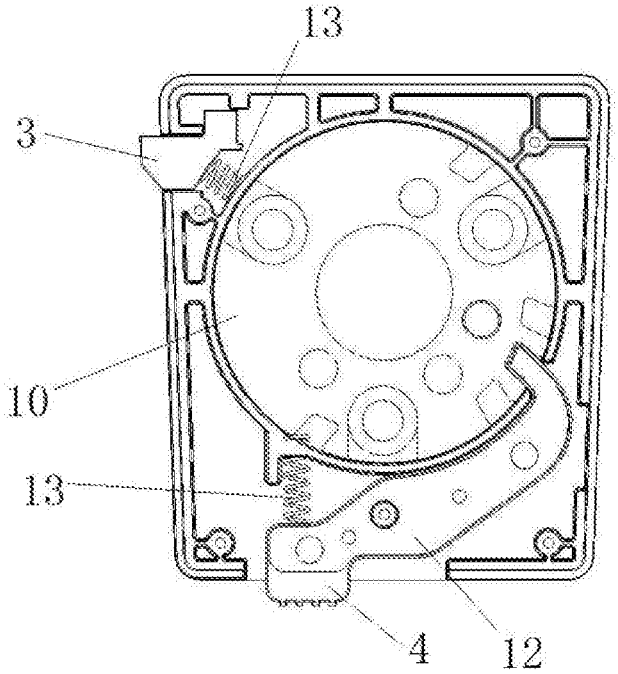
FIG. 12 is a schematic view showing the internal structure of the quick-disassembly main body according to Embodiment 2 of the present disclosure.

A rotating gear of main body 10 is mounted in the central position of the quick-disassembly main body 1. A plurality of toggle grooves are uniformly provided in the rotating gear of main body 10 in circumferential direction, as shown in FIG. 12.

In this embodiment, the shape of the quick-disassembly main body 1 is of a square block structure, and the first pressing button 3 is mounted on the upper position at one side of the quick-disassembly main body, and the first pressing button 3 and the rotating gear of main body 10 are connected by a spring 13. The first pressing button 3 can be pressed into the interior of the quick-disassembly main body 1 and can automatically rebound. By pressing the first pressing button 3, the quick separation of the quick-disassembly main body 1 and the sliding slot 2 is realized.

A second pressing button 4 is disposed at the bottom of the quick-disassembly main body 1, and the second pressing button 4 is offset from the bottom center position of the quick-disassembly main body 1.

The second pressing button 4 is a member protruding from the surface of the quick-disassembly main body 1, of which shape can be arbitrarily set; the surface of the second pressing button 4 is provided with convex points for easy operation.

The second pressing button 4 is connected to the toggle hook 12, the toggle hook 12 is rotatably connected to the quick-disassembly body 1, and the spring 13 is connected between the toggle hook 12 and the rotating gear of main body 10. The second pressing button 4 is pressed, the second pressing button 4 drives the toggle hook 12 to move, so as to make the toggle hook 12 cooperate with different toggle grooves, thereby adjusting the angle of the holster, so that the user can adjust the appropriate angle to perform any action.

The rotating gear of main body 10 of the quick-disassembly main body 1 are provided with a plurality of the first mounting holes 7.

Preferably, three first mounting holes 7 are provided in the quick-disassembly main body 10, and the three first mounting holes 7 are in triangular distribution.

The first mounting hole 7 is a threaded hole, and the quick quick-disassembly main body 1 is connected with the holster by screwing a screw in the first mounting hole 7.

The sliding slot 2 is sleeved on the outer side of the quick-disassembly main body 1, and one side of the sliding slot opens and the other sides are closed, and the whole shape of the sliding slot is U-shaped, which is wrapped on the outer side of the quick-disassembly main body 1.

The outer wall of the quick-disassembly main body 1 is in contact with the inner wall of the sliding slot 2.

One side of the sliding slot 2 is provided with the first clamping slot 8 that cooperates with the first pressing button 3, and the second clamping slot 9 that cooperates with the second pressing button 4 is disposed at the bottom thereof.

The first clamping slot 8 and the second clamping slot 9 are respectively provided with slotted holes for the first pressing button 3 and the second pressing button 4 to pass through.

The sliding slot 2 is provided with a second mounting hole 5 corresponding to the position of the first mounting hole 7 for connecting the waist guard.

Preferably, three second mounting holes 5 are provided in the sliding slot 2, and the three second mounting holes 5 are in triangular distribution.

The usage method of this embodiment is:

The part of the rotating gear of main body 10 of the quick-disassembly main body 1 is connected with the holster through a screw, and the sliding slot 2 is fixed with the waist guard by the screw, and the quick-disassembly main body 1 slides down into the sliding slot. At this time, the first pressing button 3 is disposed in the first clamping slot 8, the second pressing button 4 is disposed in the second clamping slot 9 to realize quick connection between the holster and the waist guard.

When the holster and the waist guard are to be separated, the first pressing button 3 is pressed, and the holster connected to the quick-disassembly main body 1 is pulled out to realize the quick release function.

The above is only specific embodiments of the present disclosure, and those skilled in the art can easily conceive changes within the scope of the present disclosure, which are within the scope of protection of the disclosure.

The invention claimed is:

1. A quick disassembly and assembly device for a holster and a waist guard, comprising a detachable quick-disassembly main body and a sliding slot, wherein the quick-disassembly main body is sleeved inside the sliding slot; a first pressing button is mounted on one side of the quick-disassembly main body, and a first clamping slot, which is matched with the first pressing button, is provided on one side of the sliding slot, the first pressing button is connected to a rotating gear of the main body by a spring, the first pressing button passes through the first clamping slot to extend out of the sliding slot, and the first pressing button is capable of moving along the first clamping slot to compress the spring until the first pressing button disengages from the first clamping slot to separate the quick-disassembly main body from the sliding slot;

a second pressing button is disposed on a bottom of the quick-disassembly main body, and a second clamping slot, which is matched with the second pressing button, is provided on a bottom of the sliding slot; the rotating gear of main body is provided on a center of the quick-disassembly main body, the rotating gear of main body is connected to the second pressing button by a toggle hook, and an angle of the rotating gear of the main body is adjusted by pressing the second pressing button.

2. The quick disassembly and assembly device for a holster and a waist guard according to claim 1, wherein the toggle hook is connected to the rotating gear of the main body by a spring.

3. The quick disassembly and assembly device for a holster and a waist guard according to claim 1, wherein a toggle groove is provided in the rotating gear of the main body at intervals in a circumferential direction; wherein the toggle groove matches with the toggle hook.

4. The quick disassembly and assembly device for a holster and a waist guard according to claim 1, wherein the quick-disassembly main body is slidably connected to the sliding slot.

5. The quick disassembly and assembly device for a holster and a waist guard according to claim 4, wherein an outer wall of the quick-disassembly main body is in contact with an inner wall of the sliding slot.

6. The quick disassembly and assembly device for a holster and a waist guard according to claim 1, wherein the quick-disassembly main body, the sliding slot and the rotating gear of the main body are provided with a center hole.

7. The quick disassembly and assembly device for a holster and a waist guard according to claim 1, wherein the quick-disassembly main body and the sliding slot are provided with a plurality of mounting holes, respectively.

8. The quick disassembly and assembly device for a holster and a waist guard according to claim 7, wherein three first mounting holes are provided in the quick-disassembly main body, and the three first mounting holes are in triangular distribution.

9. The quick disassembly and assembly device for a holster and a waist guard according to claim 7, wherein three second mounting holes are provided in the sliding slot, and the three second mounting holes are in triangular distribution.

10. The quick disassembly and assembly device for a holster and a waist guard according to claim 1, wherein the second pressing button passes through the second clamping slot.

* * * * *